US010816195B2

(12) United States Patent
Cadima

(10) Patent No.: US 10,816,195 B2
(45) Date of Patent: Oct. 27, 2020

(54) GAS BURNER WITH SILENT CYCLING FEATURES

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 180 days.

(21) Appl. No.: 15/978,231

(22) Filed: May 14, 2018

(65) Prior Publication Data

US 2019/0346135 A1 Nov. 14, 2019

(51) Int. Cl.

| | |
|---|---|
| ***F23D 14/06*** | (2006.01) |
| ***F23D 14/70*** | (2006.01) |
| ***F23D 14/26*** | (2006.01) |
| ***F23N 5/10*** | (2006.01) |
| ***F23N 5/20*** | (2006.01) |
| *F24C 3/08* | (2006.01) |
| *F24C 3/02* | (2006.01) |

(52) U.S. Cl.

CPC ..... *F23D 14/70* (2013.01); *F23D 14/06* (2013.01); *F23D 14/26* (2013.01); *F23N 5/105* (2013.01); *F23N 5/203* (2013.01); *F23D 2900/14481* (2013.01); *F24C 3/027* (2013.01); *F24C 3/085* (2013.01)

(58) Field of Classification Search

CPC ..... F23D 14/70

USPC ..... 431/284, 349

See application file for complete search history.

(56) References Cited

U.S. PATENT DOCUMENTS

| | | | | |
|---|---|---|---|---|
| 2,208,956 A * | 7/1940 | Allenbaugh | F16K 31/485 431/60 |
| 2,373,189 A * | 4/1945 | Klein | F16K 31/485 431/60 |
| 2,939,524 A * | 6/1960 | Mathis | F23N 1/007 236/99 R |
| 5,488,942 A * | 2/1996 | Maughan | F23D 14/06 126/39 E |
| 5,800,159 A * | 9/1998 | Maughan | F23D 14/06 126/39 E |
| 6,315,552 B1 * | 11/2001 | Haynes | F23D 14/06 239/553 |
| 9,453,641 B2 | 9/2016 | Cadima | |
| 2006/0051718 A1 * | 3/2006 | Kamal | F23D 14/06 431/354 |

FOREIGN PATENT DOCUMENTS

CN 203478250 U 3/2014

* cited by examiner

*Primary Examiner* — Avinash A Savani

(74) *Attorney, Agent, or Firm* — Dority & Manning, P.A.

(57) ABSTRACT

A gas burner assembly for a cooktop appliance is provided. The gas burner has a gas stability chamber for providing a re-ignition source to primary burner ports positioned around the burner without the noises associated with spark controlled cycled burners. The stability chamber may entrain air from above the cooktop appliance for increased stability.

19 Claims, 10 Drawing Sheets

GAS BURNER WITH SILENT CYCLING FEATURES

FIELD OF THE INVENTION

The present disclosure relates generally to a gas burner for a cooktop of an appliance.

BACKGROUND OF THE INVENTION

Recently, connected appliances and digitally controlled features of such appliances have grown more popular. For example, some electric cooktops include temperature sensors made to pair with certain appliances as either an accessory that may be mounted onto cookware or embedded within special cookware. Real time feedback of food temperatures allows users to operate their electric cooktops with precision in closed loop mode regardless of the food loads. Thus, precision cooking methods, such as e.g., sous vide and other assisted cooking techniques, may be achieved with an electric cooktop. To achieve lower heat outputs, electric cooking elements may be cycled on and off or may be set at a low heat output to achieve the desired lower heat output. Electric cooktops can be controlled silently and can be shut off entirely and restarted without concern as to whether or not a flame was relighted.

Gas burners are commonly used on the cooktops of household gas cooking appliances including e.g., range ovens and cooktops built into cabinetry. However, gas burners are limited to how low they can operate in a continuous state (i.e., their lowest rate, known informally as the simmer rate). Yet many functions employed by connected appliances require lower heat settings than conventional gas burners can provide.

In order to realize a lower heat output, one solution has been to cycle the burner on and off to provide a lower, average input rate. For instance, an electronic control shuts the burner off for a predetermined time via a solenoid valve and relights the burner. The electronics energize the spark igniter each cycle to relight the burner, and stop the sparking if/when a flame is sensed, e.g., using flame rectification. There are drawbacks to this solution. For instance, each time the burner is relit, a sparking noise inherent in spark ignition systems is generated. Many consumers may find this sound to be a nuisance, particularly if the burner is cycling every thirty to forty-five seconds. If multiple burners are cycling, the sparking noise may become more frequent thereby exacerbating the nuisance. Another drawback to cycling the burner on and off is the reliance of the control electronics to determine if the flames have been rectified after gas has been automatically released again after shutting the burner off.

Accordingly, a gas burner for a cooktop appliance that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one exemplary embodiment, a gas burner assembly for a cooktop appliance is provided. The gas burner assembly includes a burner body comprising a sidewall surrounding a main mixing chamber defined by a main throat having a gas inlet and a gas outlet. The gas burner assembly also includes a cap mounted to the burner body, the cap and the burner body defining a main fuel chamber, the main fuel chamber in fluid communication with the main mixing chamber through the gas outlet. Further, the gas burner assembly includes a plurality of primary burner ports defined along the sidewall of the burner body and in fluid communication with the main fuel chamber. Moreover, the gas burner assembly includes a simmer flame port defined along the sidewall of the burner body and spaced from the plurality of primary burner ports, the simmer flame port configured to provide a reignition source for the primary burner ports. The gas burner assembly also includes a stability chamber located adjacent to the simmer flame port, the stability chamber in fluid communication with the simmer flame port, wherein the stability chamber and the simmer flame port are not in fluid communication with the main fuel chamber and the plurality of primary burner ports.

In another exemplary embodiment, a method for operating a gas burner assembly for a cooktop appliance in a cooking operation, the burner assembly comprising a burner body comprising a main throat defining a main mixing chamber, the burner assembly further comprising a cap mounted to the burner body, the cap and the burner body defining a main fuel chamber, the burner body defining a plurality of primary burner ports in fluid communication with the main fuel chamber and a simmer flame port spaced from the primary burner ports, the burner assembly further comprising a stability chamber located adjacent to and in fluid communication with the simmer flame port, the stability chamber and the simmer flame port are not in fluid communication with the main fuel chamber and the plurality of primary burner ports, the burner assembly further comprising a main supply line in fluid communication with the main fuel chamber, a control valve movable between an open position and a closed position and positioned along the main supply line, and a stability supply line in fluid communication with the main supply line upstream of the control valve, the stability supply line in fluid communication with the stability mixing throat. The method includes: closing the control valve to the closed position to shutoff a gas flow to the main fuel chamber; determining whether a predetermined time has elapsed or whether a predetermined temperature has been met; and opening the control valve to the open position to allow the gas flow to the main fuel chamber, wherein upon opening the control valve, a simmer flame propagating through the simmer flame port ignites a plurality of flames that propagate through the plurality of primary burner ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of identical reference numerals in different figures denotes the same or similar components or features.

DETAILED DESCRIPTION OF THE INVENTION

Figure 1:
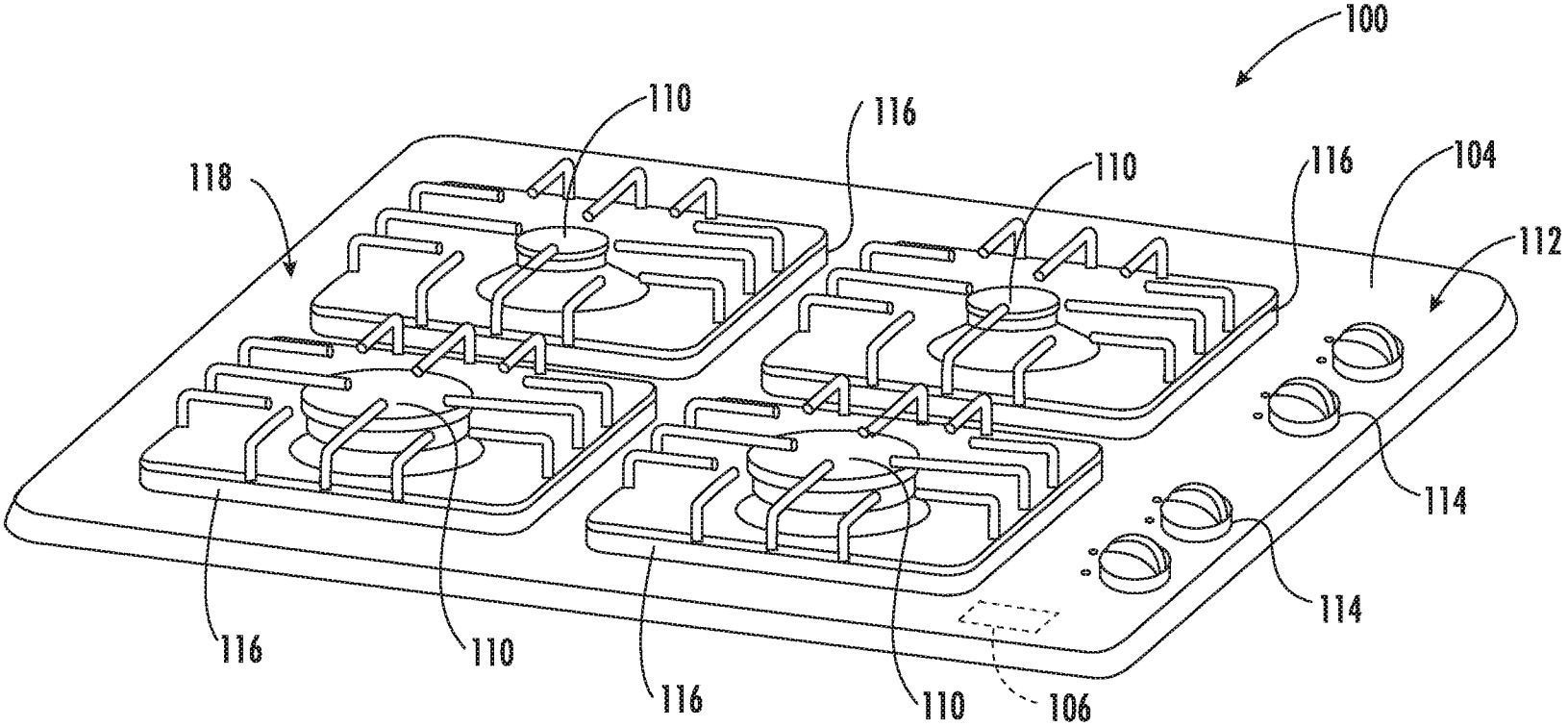
FIG. 1 provides a perspective view of an exemplary cooktop appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exemplary embodiment of a cooktop appliance 100 as may be employed with the present subject matter. Cooktop appliance 100 includes a top panel 104. By way of example, top panel 104 may be constructed of glass, ceramics, enameled steel, and combinations thereof. Top panel 104 may be part of a range or other appliance, or panel 104 may be a stand-alone appliance.

For cooktop appliance 100, a utensil holding food and/or cooking liquids (e.g., oil, water, etc.) may be placed onto grates 116 at a location of any of a plurality of burner assemblies 110. As shown in FIG. 1, burner assemblies 110 can be configured in various sizes so as to provide e.g., for the receipt of cooking utensils (i.e., pots, pans, etc.) of various sizes and configurations and to provide different heat inputs for such cooking utensils. Grates 116 are supported on a top surface 118 of top panel 104.

Burner assemblies 110 provide thermal energy to cooking utensils on grates 116. In particular, burner assemblies 110 extend through top panel 104 below grates 116. Burner assemblies 110 are also mounted to top panel 104. Burner assemblies 110 provide for combustion of a gaseous fuel to provide heat energy for cooking.

A user interface panel 112 is located within convenient reach of a user of the cooktop appliance 100. For this exemplary embodiment, panel 112 includes controls or knobs 114 that are each associated with one of burner assemblies 110. Knobs 114 allow a user to activate each burner assembly 110 and determine the amount of heat input provided by each burner assembly 110 to a cooking utensil located thereon. Panel 112 may also be provided with one or more graphical display devices that deliver certain information to the user such as e.g., whether a particular burner assembly is activated and/or the level at which the burner assembly is set.

Although shown with knobs 114, it should be understood that knobs 114 and the configuration of cooktop appliance 100 shown in FIG. 1 are provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user.

Cooktop appliance 100 also includes a controller 106, e.g., configured to control one or more operations of cooktop appliance 100. For example, controller 106 may control at least one operation of cooktop appliance 100 that includes one or more of burner assemblies 110. Controller 106 may be in communication (via a suitable wired or wireless connection) with burner assemblies 110, user interface panel 112, one or more temperature sensing devices, and other suitable components of the cooktop appliance 100. In general, controller 106 may be operable to configure the cooktop appliance 100 (and various components thereof) for a cooking operation, e.g., such as a precision cooking operation. Such configuration may be based, for instance, on a plurality of cooking factors of a selected operating cycle or mode, e.g., as selected at user interface panel 112.

By way of example, controller 106 may include one or more memory devices and one or more microprocessors, such as general or special purpose microprocessors operable to execute programming instructions or micro-control code associated with an operating cycle. The memory device (i.e., memory) may represent random access memory such as DRAM, or read only memory such as ROM or FLASH. In one embodiment, the processor executes programming instructions stored in memory. The memory may be a separate component from the processor or may be included onboard within the processor. The memory can store information accessible to processing device, including instructions that can be executed by processing device. Optionally, the instructions can be software or any set of instructions that, when executed by the processing device, cause the processing device to perform operations. For certain embodiments, the instructions include a software package configured to operate cooktop appliance 100 and interpret one or more electrical signals. For example, the instructions may include a software package configured to execute commands based on feedback from a temperature sensing device communicatively coupled with controller 106.

Controller 106 may be positioned in a variety of locations throughout cooktop appliance 100. As illustrated, controller 106 may be located within top panel 104 of cooktop appliance 100 as shown in FIG. 1. In such embodiments, input/output ("I/O") signals may be routed between controller 106 and various operational components of cooktop appliance 100, such as controls of user interface panel 112, gas control valves, sensors, and/or other components as may be provided.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that are part of an oven such as e.g., range appliances.

Figure 2:
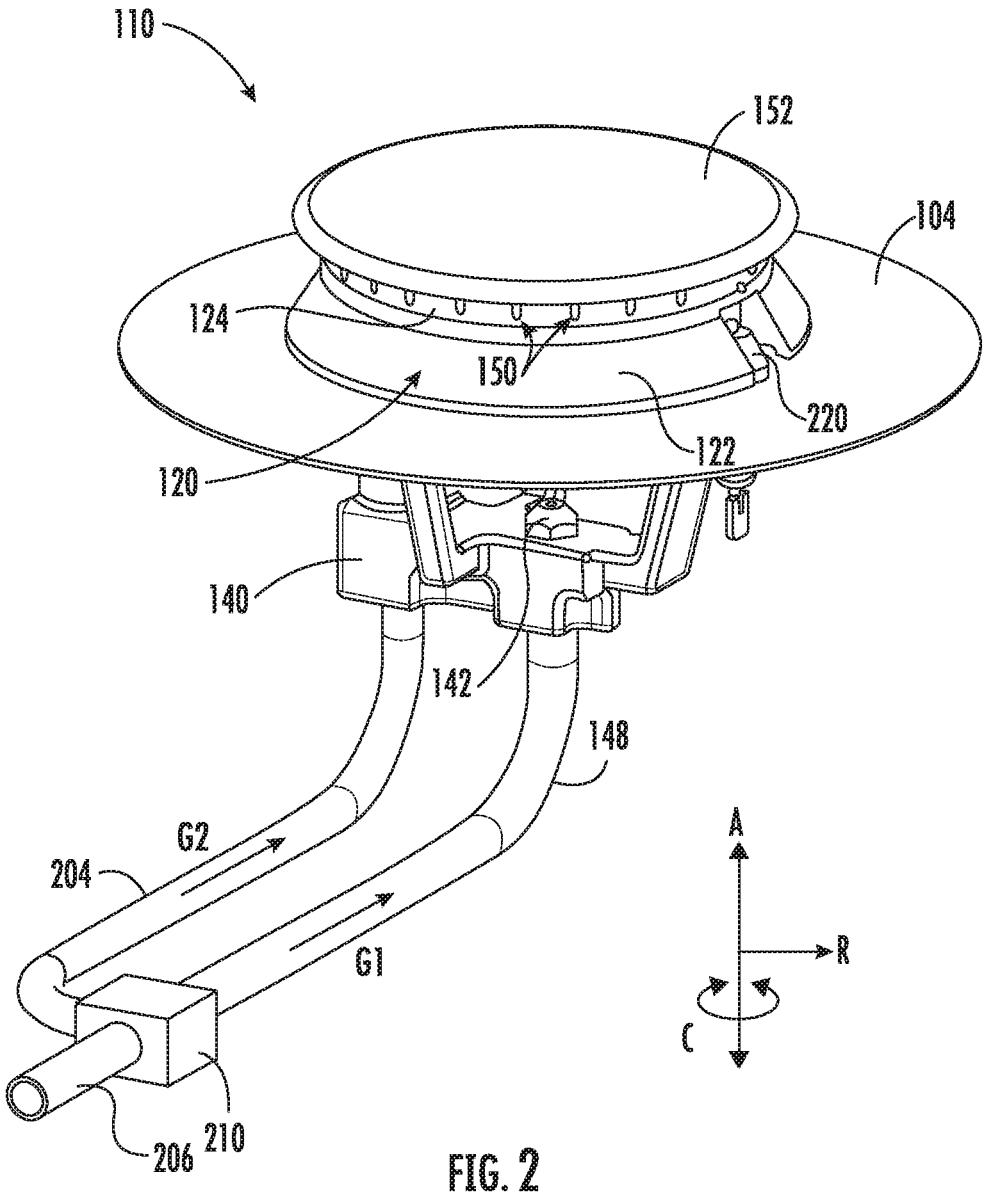
FIG. 2 provides a perspective view of an exemplary burner assembly according to an exemplary embodiment of the present disclosure.
Figure 3:
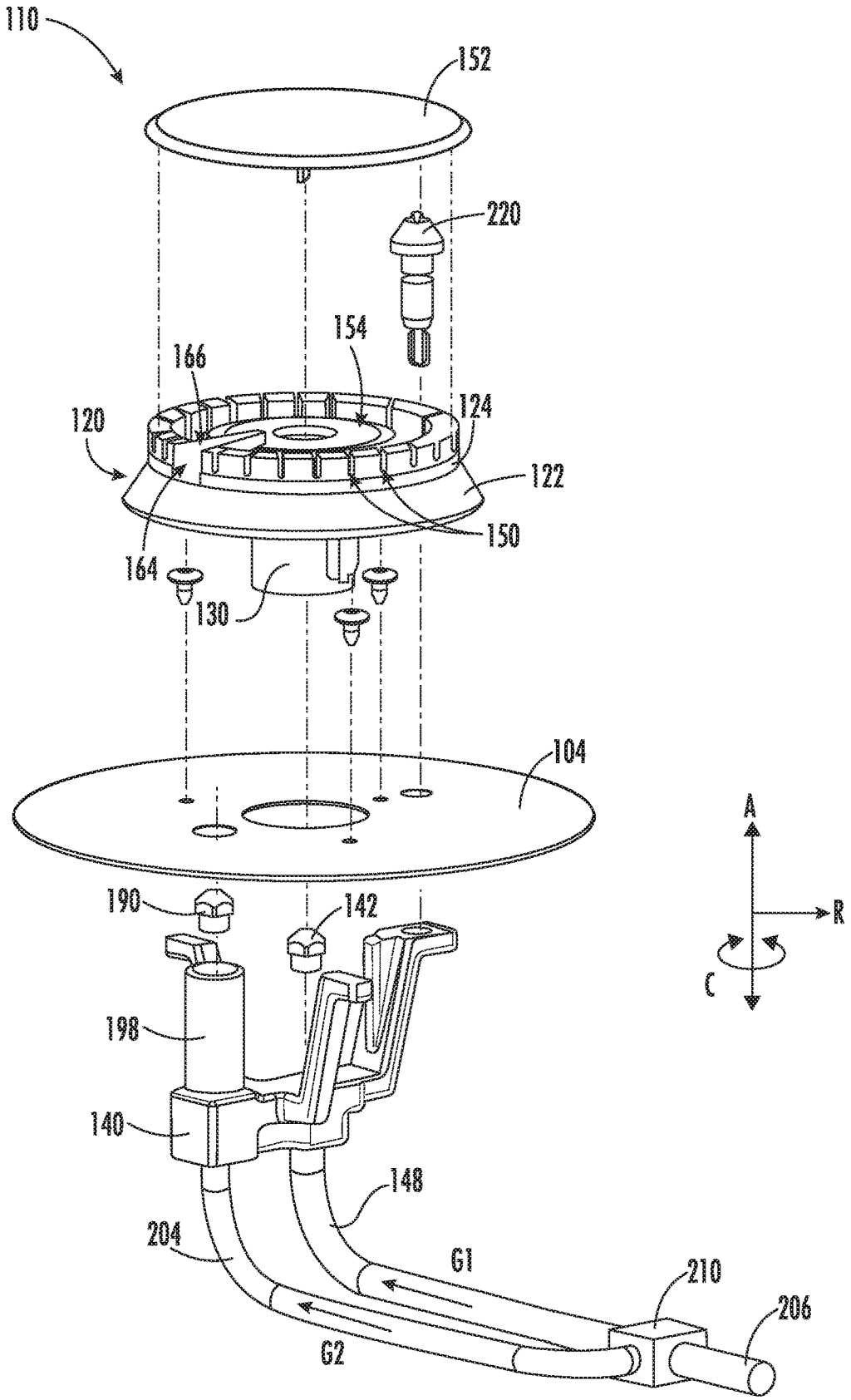
FIG. 3 provides a perspective exploded view of the burner assembly of FIG. 2.
Figure 4:
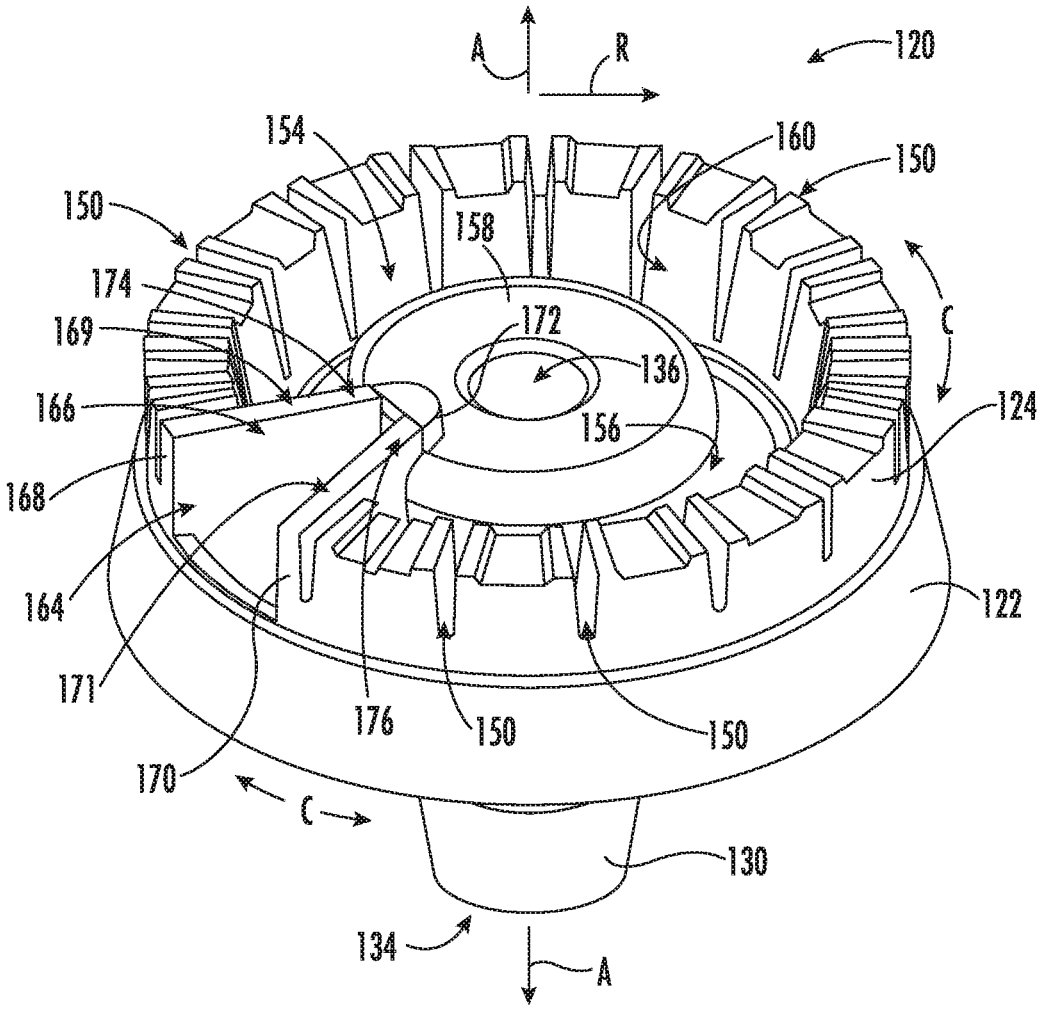
FIG. 4 provides a perspective view of a burner body of the burner assembly of FIG. 2.
Figure 5:
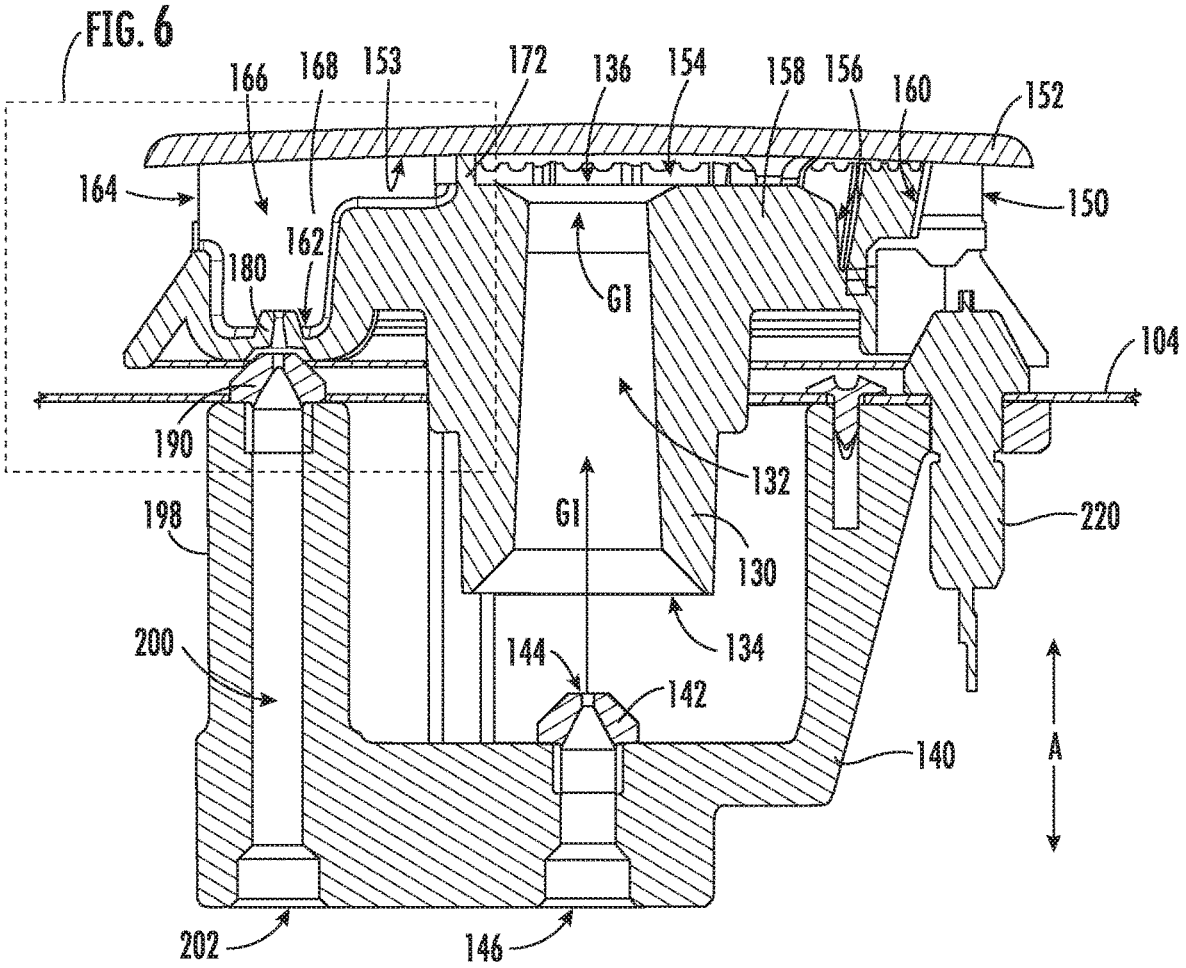
FIG. 5 provides a cross-sectional view of the burner assembly of FIG. 2.
Figure 6:
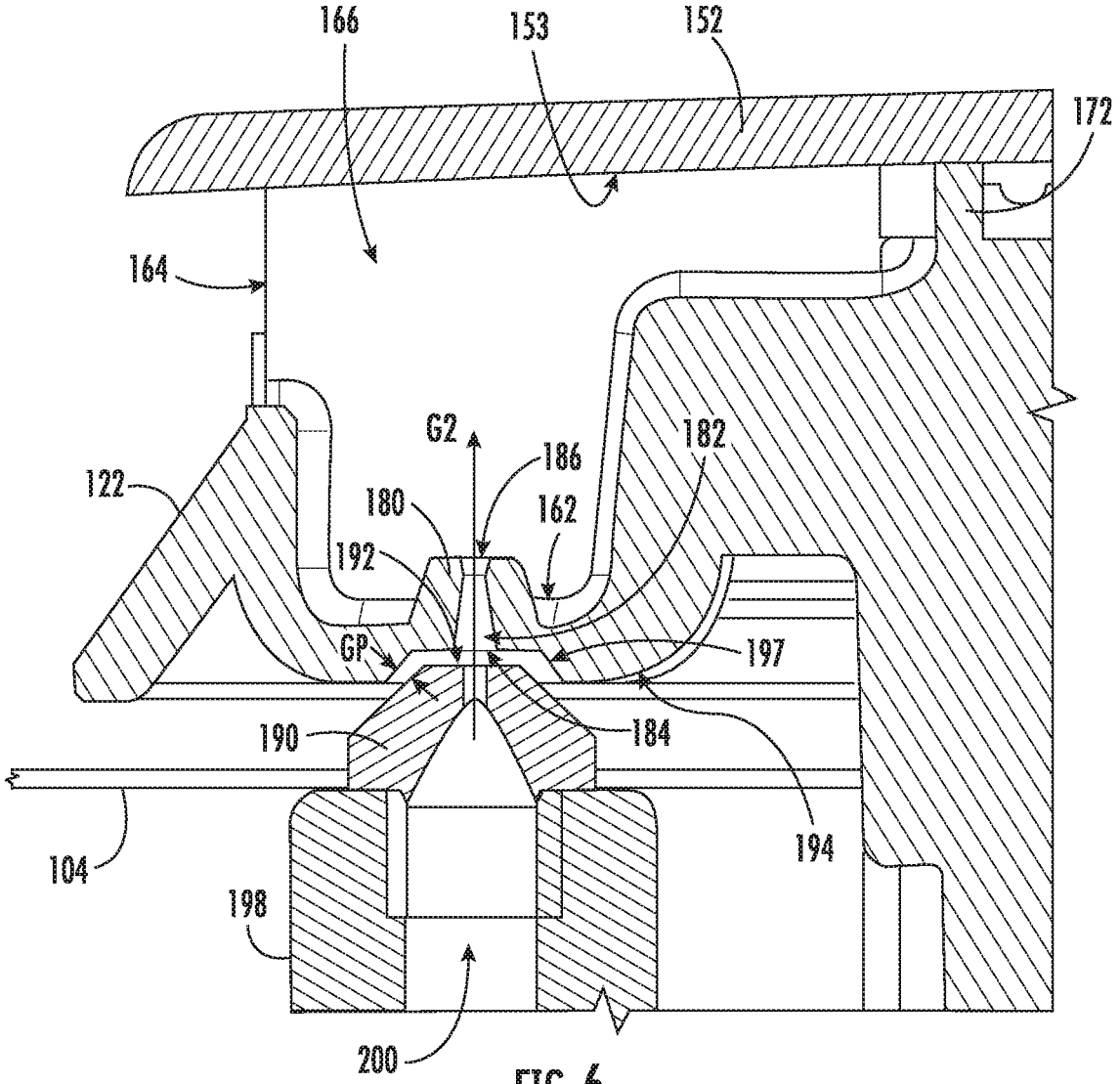
FIG. 6 provides a close up view of Section 6 of FIG. 5.
Figure 7:
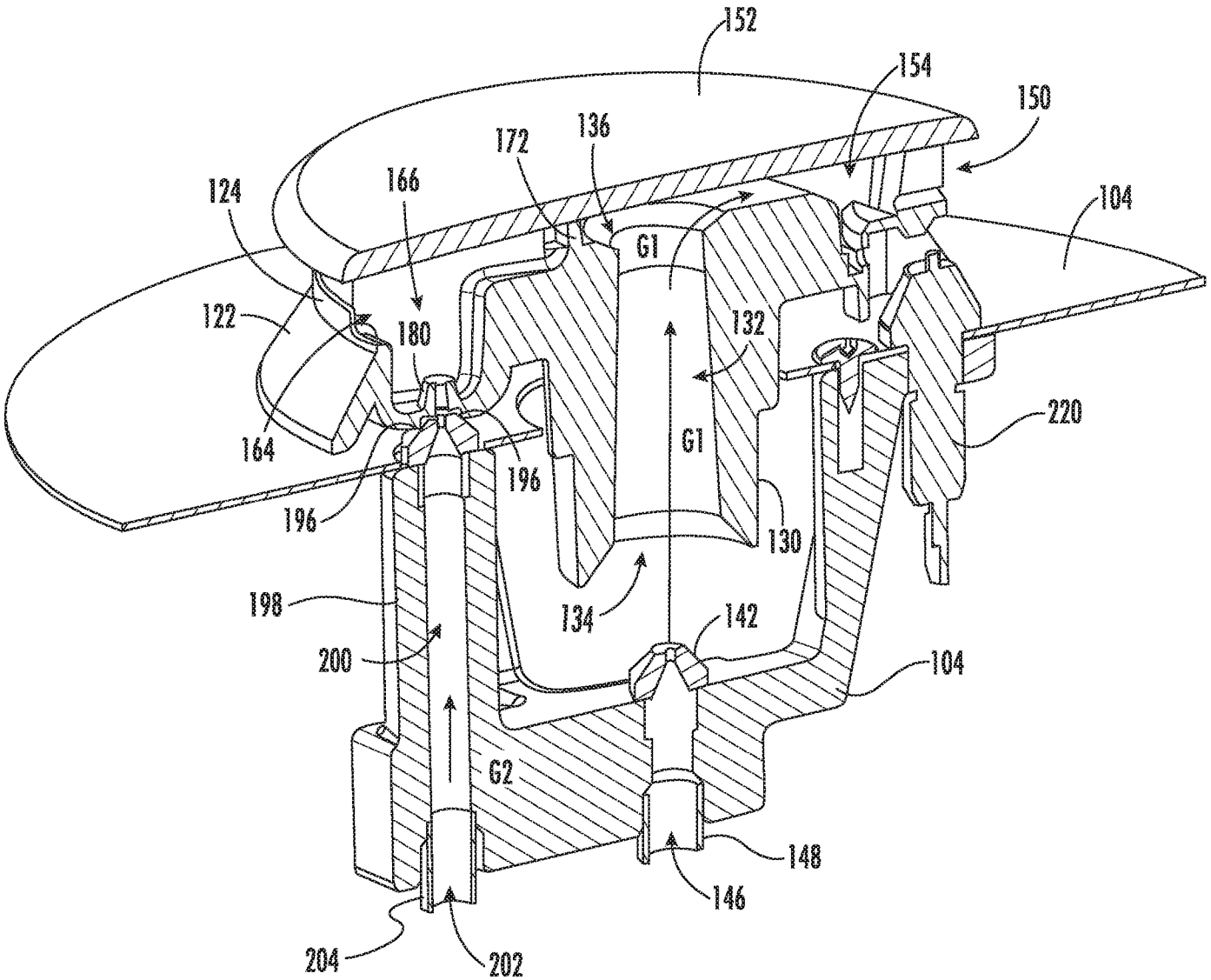
FIG. 7 provides a perspective, cross-sectional view of the burner assembly of FIG. 2.
Figure 8:
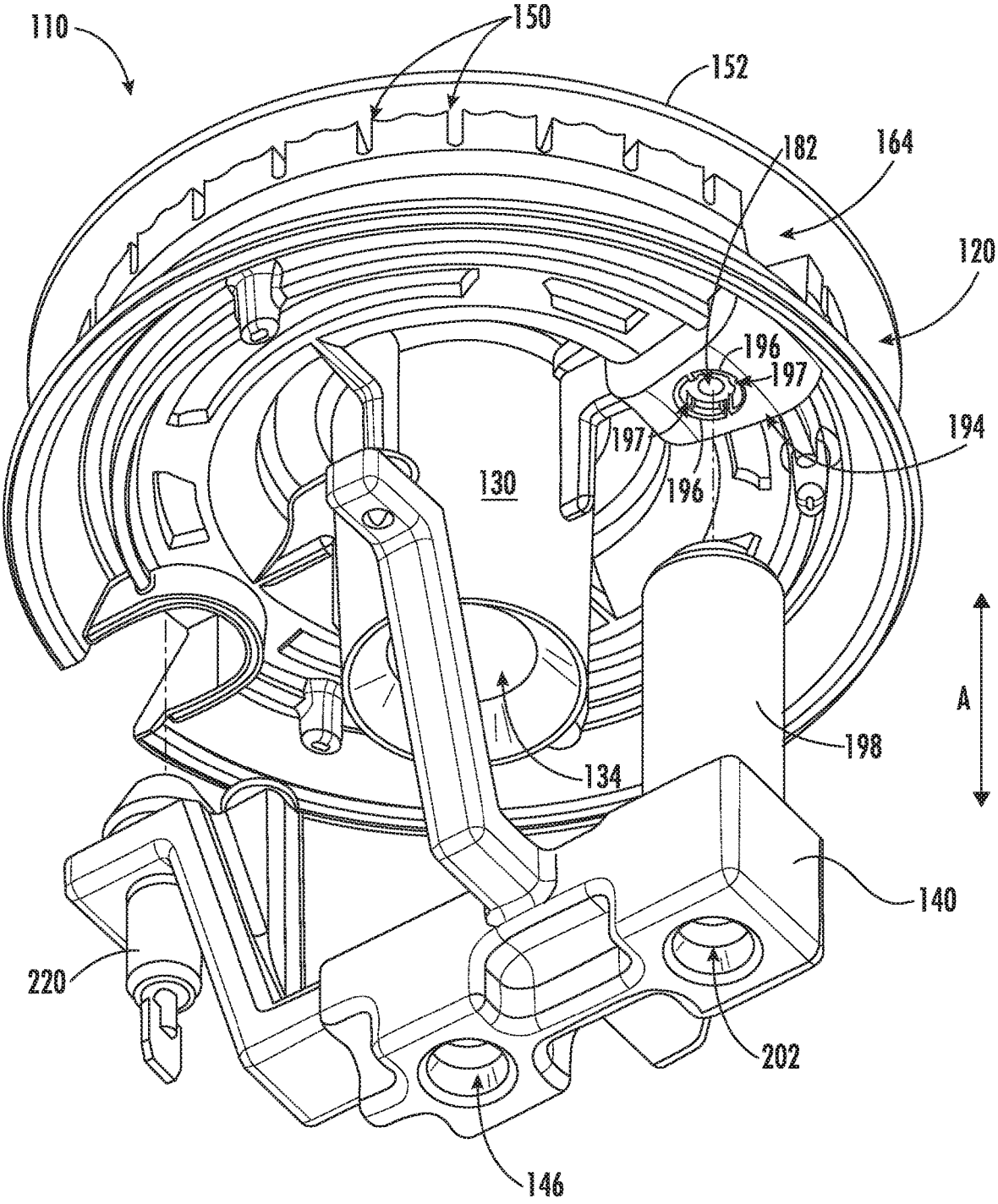
FIG. 8 provides a bottom perspective view of the burner assembly of FIG. 2.

FIGS. 2 through 8 provide various views of exemplary burner assembly 110 as may be used with cooktop appliance 100 of FIG. 1. In particular, FIG. 2 provides a perspective view of burner assembly 110. FIG. 3 provides an exploded, perspective view of burner assembly 110. FIG. 4 provides a perspective view of a burner body of the burner assembly 110. FIG. 5 provides a side, cross-sectional view of burner assembly 110. FIG. 6 provides a close up view of Section 6 of FIG. 5. FIG. 7 provides a perspective, cross-sectional view of burner assembly 110. FIG. 8 provides a bottom perspective view of burner assembly 110. Burner assembly 110 defines an axial direction A, a radial direction R, and a circumferential direction C extending about the axial direction A, see e.g., FIG. 2.

As shown in FIGS. 2 and 3, burner assembly 110 includes a burner body 120 having a frustum-shaped base portion 122 and cylindrical or annular sidewall 124 extending along the axial direction A from the periphery of base portion 122. Base portion 122 can be e.g., attached to top panel 104 of cooktop appliance 100 or another mounting structure. Sidewall 124 extends around the circumferential direction C of burner body 120.

As shown best in FIG. 5, burner body 120 includes a main throat 130 projecting along the axial direction A. Main throat 130 defines a main mixing chamber 132 having a gas inlet 134 and a gas outlet 136 for gas flow G1. Sidewall 124 surrounds main mixing chamber 132 defined by main throat 130. As used herein, "gas" or "gas flow" or "fuel" refers to a combustible gas or gaseous fuel mixture. The diameter of gas inlet 134 is greater than the diameter of gas outlet 136. Burner assembly 110 includes a burner support bracket 140 positioned generally below burner body 120, e.g., along the axial direction A. Burner support bracket 140 defines a recess in which a main metering jet 142 is received. Main metering jet 142 defines an orifice 144 that serves as a nozzle to meter or control the gas flow G1 into gas inlet 134 of main mixing chamber 132. Burner support bracket 140 also defines a main inlet port 146 that is configured to receive a main supply line 148, e.g., as shown in FIG. 7.

With reference now specifically to FIG. 4, as shown, sidewall 124 of burner body 120 defines a plurality of primary burner ports 150 that, for this exemplary embodiment, are evenly spaced apart from each other along the circumferential direction C and surround gas outlet 136 of main mixing chamber 132. As used herein, a "port" refers to an aperture or opening of any shape from which a flame may be supported.

As depicted best in FIGS. 3 through 5, burner assembly 110 includes a cap 152 that is received onto the top of burner body 120. When cap 152 is mounted to burner body 120, a main fuel chamber 154 is defined between cap 152 and burner body 120. More specifically, main fuel chamber 154 is defined by cap 152, an outer surface 156 of a toroidal projection 158 (FIG. 5), inner surface 160 of sidewall 124, and upper surface 162 of burner body 120. Through gas outlet 136 and main fuel chamber 154, primary burner ports 150 are in fluid communication with gas flow G in main mixing chamber 132 of main throat 130.

As shown in FIG. 4, sidewall 124 defines a simmer flame port 164 that is spaced along circumferential direction C from primary burner ports 150 and is configured to provide a reignition source for primary burner ports 150. While only a single simmer flame port 164 is shown, it should be understood that multiple ports could be used. Simmer flame port 164 is in fluid communication with a stability chamber 166 defined by burner body 120 and cap 152. Notably, simmer flame port 164 and stability chamber 166 are not in fluid communication with main fuel chamber 154. Stated differently, simmer flame port 164 and stability chamber 166 are not fluidly connected to or with main fuel chamber 154 through any internal passages or openings. Stability chamber 166 and main fuel chamber 154 are isolated volumes. Thus, stability chamber 166 is hermetically sealed from main fuel chamber 154 or at least sealed to a degree in which a negligible amount of gas is allowed to pass therebetween. A negligible amount of gas is deemed an amount that is insufficient to provide a stable flame at the primary burner ports 150 or simmer flame port 164.

Stability chamber 166 is defined along its sides by a pair of radially extending baffles 168, 170 that are positioned in an opposing manner from each other along circumferential direction C, along a bottom by an upper surface 162 of burner body 120, and burner cap 152. An end wall 172 is positioned proximate to gas outlet 136 of main mixing chamber 132 and further defines stability chamber 166 in this exemplary embodiment. End wall 172 is positioned radially inward of the simmer flame port 164 and joins radially inward ends 174, 176 of baffles 168, 170, respectively. Upper surface 162 defines a depth of the stability chamber 166 that is greater nearest simmer flame port 164 than a depth nearest gas outlet 136.

Further, as shown in FIG. 4, top surfaces 169 and 171 of baffles 168 and 170, respectively, are slightly curved along their lengths to match or complement the curvature of cap 152 and extend uninterrupted (i.e. no gaps or notches) along radial direction R between simmer flame port 164 and end wall 172. When burner cap 152 is mounted thereto, a bottom surface 153 of burner cap 152 contacts the top surfaces 169, 171 of baffles 168, 170. Further, bottom surface 153 of burner cap 152 is in sealing engagement with end wall 172, e.g., as shown in FIG. 5. Accordingly, stability chamber 166 is isolated from main fuel chamber 154.

As shown in FIGS. 5 and 6, stability chamber 166 has an inlet and an outlet. The outlet of stability chamber 166 is simmer flame port 164 and the inlet of stability chamber 166 is defined by a stability chamber venturi 180. Stability chamber venturi 180 defines a stability mixing throat 182. The stability mixing throat 182 has an inlet 184 and an outlet 186. The outlet 186 of stability mixing throat 182 defines the inlet to stability chamber 166. The inlet 184 of stability mixing throat 182 has an inlet diameter that is greater than an outlet diameter of the outlet 186 of the stability mixing throat 182.

Further, as shown, a stability metering jet 190 defining a jet orifice 192 is positioned such that jet orifice 192 is in alignment and fluid communication with the inlet 184 of the stability mixing throat 182. In preferred embodiments, the jet orifice 192 of stability metering jet 190 is concentrically positioned in alignment with the inlet 184 of stability mixing throat 182. In addition, burner body 120 includes a bottom surface 194 spaced from upper surface 162, e.g., along the axial direction A. As shown best in FIG. 8, ribs 196 project from bottom surface 194, e.g., along the axial direction A. In such embodiments, ribs 196 may be spaced from one another along the circumferential direction C about the inlet 184 of stability mixing throat 182. Slots 197 are defined between adjacent ribs 196. When burner body 120 is mounted to top panel 104, the ribs 196 are seated on or substantially near stability metering jet 190. This stabilizes burner body 120 in place. In FIG. 8, burner support bracket 140 is moved downward along the axial direction A to better show the features along the bottom of burner body 120.

As shown best in FIG. 6, one or more gaps GP are defined between stability metering jet 190 and stability chamber venturi 180 of burner body 120. The gaps GP between stability metering jet 190 and stability chamber venturi 180 of burner body 120 are provided by slots 197. The gaps GP allow primary air to be entrained into stability mixing throat 182. Notably, the one or more gaps GP are positioned or defined above top panel 104, e.g., along the axial direction A. Accordingly, the air entrained and mixed in stability mixing throat 182 is air from above cooktop appliance 100. Thus, stability mixing throat 182 is not or minimally affected by sudden pressure disturbances beneath top panel 104 of cooktop appliance 100. Consequently, the simmer flame may achieve better flame stability.

As shown best in FIGS. 5 and 7, a jet holder 198 connected to burner support bracket 140 defines a recess in which stability metering jet 190 is received. Jet holder 198 and burner support bracket 140 define a passage 200 that extends along the axial direction A. Passage 200 provides fluid communication between stability metering jet 190 and a stability inlet port 202 defined by burner support bracket 140. Stability inlet port 202 is configured to receive a stability supply line 204 (FIG. 7). Burner assembly 110 also includes a spark igniter 220. Spark igniter 220 is configured to ignite gas from main fuel chamber 154 so that a flame propagates through each of the primary burner ports 150. In this way, heat is provided to a cooking utensil placed on grate 116 of cooktop appliance 100.

Main supply line 148 is configured for providing gas flow G1 to main fuel chamber 154, e.g., as shown in FIG. 7. Stability supply line 204 is configured for providing a gas flow G2 to stability chamber 166. A control valve 210 is positioned along main supply line 148 and is configured to selectively adjust the gas flow G1 through main supply line 148. Control valve 210 is movable between an open position in which a fuel or gas flow G1 is allowed through or across control valve 210 and a closed position in which the gas flow G1 is prevented from flowing through or across control valve 210.

Control valve 210 may be any suitable valve configured to selectively control the amount or volume of gas that passes through main supply line 148. For instance, control valve 210 may be a manual valve, an electronically-controlled valve, or may be switchable between manual and electronic control modes. In some embodiments, control valve 210 may be one valve of a system of valves.

Figure 9:
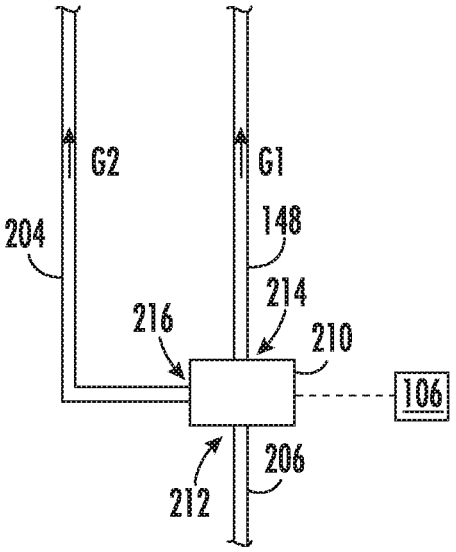
FIG. 9 provides a schematic view of an exemplary control valve of the burner assembly of FIG. 2.

As shown in FIGS. 2 and 3 and schematically in FIG. 9, for this exemplary embodiment, control valve 210 is an electronically-controlled, single inlet port and dual outlet port valve. A gas feed line 206 is fluidly connected with inlet port 212 of control valve 210. Main supply line 148 and stability supply line 204 are fluidly connected to respective outlet ports 214, 216 of control valve 210. Controller 106 (FIG. 1) of cooktop appliance 100 is communicatively coupled with control valve 210. In some embodiments, when burner assembly 110 is turned to an "on" position, controller 106 is configured to control or activate control valve 210 to selectively allow gas flow G1 to main fuel chamber 154 and gas flow G2 to stability chamber 166. Spark igniter 220 (FIG. 7) creates one or more sparks to ignite gas from main fuel chamber 154, causing a plurality of primary flames to propagate across primary burner ports 150 and a simmer flame from simmer flame port 164. In some instances, burner assembly 110 may cycle the primary flames off and on to generate the desired heat output of burner assembly 110. To cycle the primary flames off, controller 106 controls the control valve 210 to shut off the gas flow G1 to main supply line 148. As the stability chamber 166 and main fuel chamber 154 are not in fluid communication and control valve 210 has shut off the gas flow G1 to main fuel chamber 154, the primary flames become extinguished. Notably, however, controller 106 does not shut off the gas flow G2 to stability supply line 204. Consequently, the simmer flame propagating through simmer flame port 164 remains lit even when the primary flames are cycled off.

To cycle the primary flames back on, e.g., to increase the heat output of burner assembly 110 during the cooking operation, controller 106 controls the control valve 210 to allow gas flow G1 to main supply line 148, which ultimately allows for the gas flow G1 to reach main fuel chamber 154, e.g., as shown in FIG. 7. In accordance with exemplary aspects of the present disclosure, spark igniter 220 need not reignite the gas from main fuel chamber 154 to generate the primary flames; rather, the simmer flame propagating through simmer flame port 164 ignites the gas from main fuel chamber 154, e.g., by igniting the gas flow G1 flowing through an adjacent primary burner port 150. In this way, the primary flames of burner assembly 110 may be re-lit without use of spark igniter 220 and its accompanying spark noises. When a user desires to terminate the cooking operation, controller 106 controls the control valve 210 to shut off the gas flow G1 to main supply line 148 as well as the gas flow G2 to stability supply line 204. In some alternative embodiments, control valve 210 may be a manual, single inlet, dual outlet control valve.

Figure 10:
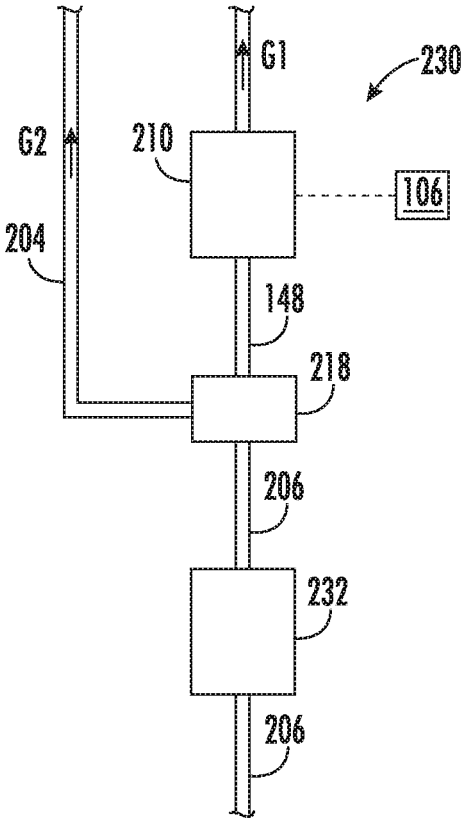
FIG. 10 provides a schematic view of an exemplary control system of a burner assembly according to an exemplary embodiment of the present disclosure.

In alternative exemplary embodiments, as shown in FIG. 10, control valve 210 may be one valve in a control system 230. In addition to control valve 210, control system 230 includes a second control valve 232. For this embodiment, control valve 210 is positioned along main supply line 148 downstream of a junction 218 where main supply line 148 fluidly connects with stability supply line 204. Control valve 210 is also positioned downstream of second control valve 232. Second control valve 232 is positioned along gas feed line 206 upstream of junction 218. For this embodiment, second control valve 232 is the main shutoff valve and control valve 210 controls the gas flow G1 to main fuel chamber 154 (FIG. 7). Further, for this embodiment, second control valve 232 is a manual valve that is movable between an open position and a closed position by user manipulation of one of the controls 114 of cooktop appliance 100 (FIG. 1). When a user manipulates control 114 to an "on" position, e.g., a low, medium, or high heat setting, second control valve 232 is moved to the open position to allow gas flow to both main fuel chamber 154 and stability chamber 166. Controller 106 activates spark igniter 220 (FIG. 7) to light the primary flames and the simmer flame.

In such embodiments, the default position of control valve 210 may be an open position. One of the settings of control 114 may be an "electronic control" option that, when selected, enables activation of control valve 210 between the open and closed positions depending on the desired heat output of burner assembly 110. In this way, control valve 210 enables the primary flames to be cycled on and off. Notably, when the primary flames are cycled off, as control valve 210 is positioned downstream of junction 218 and second control valve 232 is open when control 114 of cooktop appliance is an "electronic control" setting, gas flow G2 still flows to stability chamber 166, and accordingly, simmer flame remains lit when the primary flames are cycled off. Further, as described above, simmer flame may provide an ignition source to reignite the primary flames when controller 106 controls the control valve 210 to reopen to allow gas flow G1 to main fuel chamber 154. In such embodiments, control valve 210 may be a solenoid valve switchable between an on and off position, or open and closed positions, respectively. In yet other embodiments, control valve 210 may be a proportional control valve that may provide infinitely adjustable flow volumes through main supply line 148.

In yet further alternative embodiments, main supply line 148 and stability supply line 204 need not be in fluid communication. For instance, in some embodiments, main supply line 148 and stability supply line 204 may each independently be connected with a gas source (which may be the same gas source). One or more control valves may be positioned along main supply line 148 to selectively control the gas flow G1 to main fuel chamber 154 and one or more control valves may be positioned along stability supply line 204 to selectively control the gas flow G2 to stability chamber 166.

Figure 11:
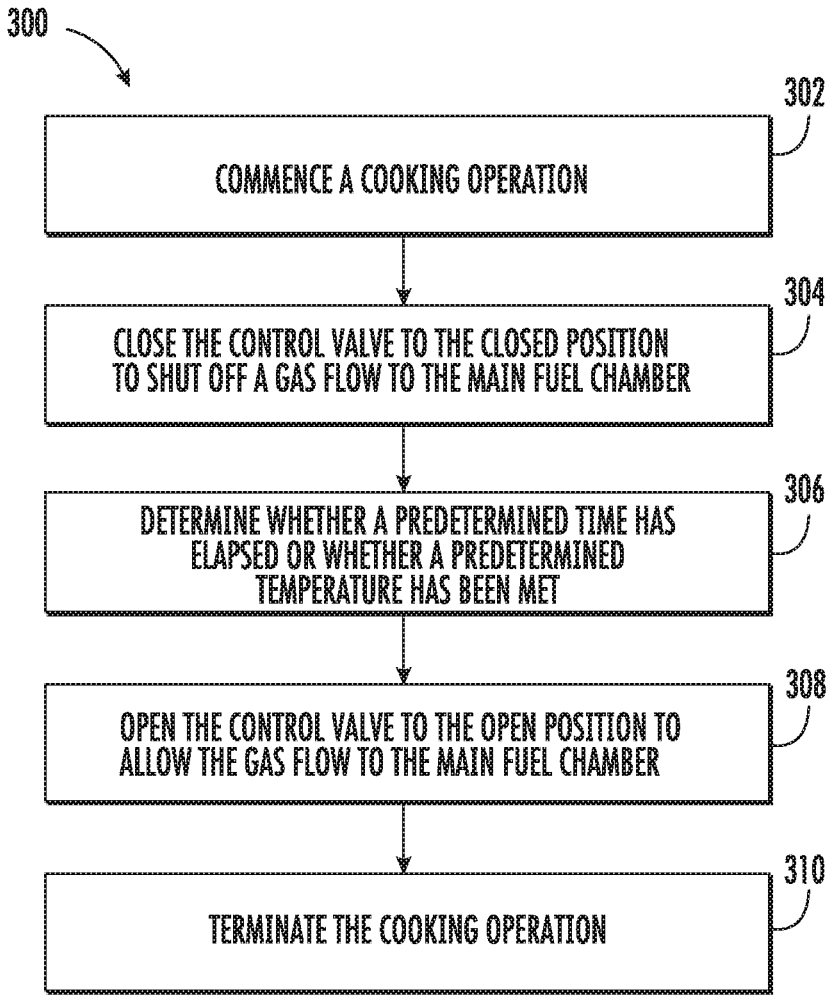
FIG. 11 provides a flow chart for an exemplary method for operating a gas burner assembly for a cooktop appliance in a cooking operation according to an exemplary embodiment of the present disclosure.

FIG. 11 provides a flow chart for an exemplary method for operating a gas burner assembly for a cooktop appliance in a cooking operation according to an exemplary embodiment of the present disclosure. Method (300) can be implemented using gas burner assembly 110 of FIGS. 2 through 8 on any suitable appliance, including for example, cooktop appliance 100 of FIG. 1. Accordingly, to provide context to method (300), reference numerals utilized to describe the features of cooktop appliance 100 and burner assembly 110 of FIG. 1 and FIGS. 2 through 8, respectively, will be used below.

For some implementations of method (300), burner assembly 110 includes burner body 120. Burner body 120 includes main throat 130 that defines main mixing chamber 132. Burner assembly 110 further includes cap 152 mounted to burner body 120. Cap 152 and burner body 120 define main fuel chamber 154. Burner body 120 also defines a plurality of primary burner ports 150 in fluid communication with the main fuel chamber 154. Burner body 120 also defines simmer flame port 164 spaced from the primary burner ports 150. Burner assembly 110 further includes stability chamber 166 located adjacent to and in fluid communication with the simmer flame port 164. The stability chamber 166 and the simmer flame port 164 are not in internal fluid communication with the main fuel chamber 154 or the plurality of primary burner ports 150. In addition, burner assembly 110 includes main supply line 148 in fluid communication with the main fuel chamber 154, control valve 210 movable between an open position and a closed position and positioned along the main supply line 148, and a stability supply line 204 in fluid communication with the main supply line 148 upstream of control valve 210. The stability supply line 204 is in fluid communication with the stability mixing throat 182.

At (302), method (300) includes commencing the cooking operation. In some implementations, commencing the cooking operation includes manipulating a control of the cooktop appliance to turn the gas burner assembly to an on position. For example, a user may manipulate one of controls 114 of cooktop appliance 100 to an "on" position to turn on burner assembly 110. The "on" position may be a general heat setting such as e.g., medium heat, or may be a specific heat setting, such as e.g., one hundred fifty degrees Fahrenheit (150° F.). Once burner assembly 110 is turned on, commencing the cooking operation also includes opening the control valve to the open position to selectively allow gas flow to the main fuel chamber. For instance, once burner assembly 110 is turned on, control 114 of cooktop appliance 100 may send one or more signals to controller 106 to activate control valve 210 to open. Controller 106 may send one or more signals to control valve 210 to move to the open position. Once control valve 210 is opened, gas is allowed to flow through main supply line 148 and eventually to main fuel chamber 154. Commencing the cooking operation further includes activating a spark igniter to ignite the gas flow in the main fuel chamber such that the plurality of flames propagate through the plurality of primary burner ports. For instance, after opening control valve 210, controller 106 may send one or more signals to spark igniter 220 to create or generate a spark. The spark, being directed toward one of the plurality of primary burner ports 150, ignites gas flowing through the port from main fuel chamber 154 to create a flame. Thereafter, the lit flame ignites a plurality of flames that propagate through the remaining primary burner ports 150. Upon commencing the cooking operation at (302), one or more of the plurality of flames ignite a simmer flame in the simmer flame port.

At (304), method (300) includes closing the control valve to the closed position to shutoff a gas flow to the main fuel chamber. For instance, suppose the cooking operation is a precision cooking operation and burner assembly 110 has been commanded by controller 106 to cycle off so that a lower temperature output may be achieved. To cycle off the burner assembly 110, controller 106 may send one or more signals to control valve 210 to close. In this way, the gas flow to the main fuel chamber 154 is shutoff, which effectively extinguishes the flames from primary burner ports 150. Notably, however, the simmer flame remains lit as gas is still supplied to stability chamber 166 via stability supply line 204. That is, simmer flame remains lit even when burner assembly is cycled off so long as burner assembly 110 is turned to an on position.

At (306), method (300) includes determining whether a predetermined time has elapsed or whether a predetermined temperature has been met. For instance, continuing with the example above, suppose the cooking operation is a precision cooking operation and the burner assembly 110 has been cycled off to reduce the output of the burner. In some implementations, the burner assembly 110 may be cycled off for a predetermined time, e.g., thirty seconds, to achieve the desired aggregate heat output of burner assembly 110. In some implementations, burner assembly 110 is cycled off until a predetermined temperature has been met. For instance, if the predetermined temperature is one hundred eighty degrees Fahrenheit (180° F.), then burner assembly 110 will remain cycled off until a sensing element instructs controller 106 that the food items of cooking utensil has reached one hundred eighty degrees Fahrenheit (180° F.).

At (308), method (300) includes opening the control valve to the open position to allow the gas flow to the main fuel chamber, wherein upon opening the control valve, a simmer flame propagating through the simmer flame port ignites a plurality of flames that propagate through the plurality of primary burner ports. For instance, after the condition is met at (306), control valve 210 may be controlled by controller 106 to open. By opening control valve 210, gas flow G1 is allowed to flow to main fuel chamber 154. The simmer flame propagating through simmer flame port 164 ignites the gas from main fuel chamber 154. That is, the simmer flame ignites the gas flowing through one of the primary burner ports 150 adjacent to simmer flame port 164. Thus, spark igniter 220 need not reignite the gas from main fuel chamber 154 to generate the primary flames, and accordingly, the primary flames may be relit "silently" or without the noise associated with creating a spark.

At (310), method (300) includes terminating the cooking operation. In some implementations, terminating the cooking operation includes manipulating the control of the cooktop appliance to turn the gas burner assembly to an "off" position. Notably, in implementations of method (300), the simmer flame is lit from a time in which the simmer flame is ignited upon commencing the cooking operation, e.g., at (302), to a time that corresponds with terminating the cooking operation, e.g., at (310). Thus, so long as burner assembly is "on," the primary flames may be cycled off and on as desired without need reignite the primary flames with spark igniter 220—the primary flames may be relit with the simmer flame propagating from simmer flame port 164.

In addition, in some implementations of method (300), burner body is mounted to top panel 104 of cooktop appliance 100. Burner assembly 110 further includes stability metering jet 190 defining a jet orifice 192. Stability metering jet 190 is positioned such that jet orifice 192 is in alignment with and in fluid communication with the inlet 184 of stability mixing throat 182. One or more gaps GP are defined between the stability metering jet 190 and stability chamber venturi 180 of burner body 120, e.g., as shown best in FIG. 6. In such implementations, the method (300) further includes entraining primary air located above the top panel of the cooktop appliance into the stability mixing throat through the one or more gaps between the stability metering jet and the stability chamber venturi of the burner body. As the one or more gaps GP provided by slots 197 are positioned above top panel 104, e.g., along the axial direction A (FIG. 6), stability mixing throat 182 may entrain the primary air located above top panel 104 of cooktop appliance 100. Accordingly, stability mixing throat 182 is not or minimally affected by sudden pressure disturbances beneath top panel 104 of cooktop appliance 100. Consequently, simmer flame may achieve better flame stability, as noted previously.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for a cooktop appliance, the gas burner assembly comprising:

a burner body comprising a sidewall surrounding a main mixing chamber defined by a main throat having a gas inlet and a gas outlet;

a cap mounted to the burner body, the cap and the burner body defining a main fuel chamber, a main supply line for providing a gas flow to the main fuel chamber, the main fuel chamber in fluid communication with the main mixing chamber through the gas outlet;

a plurality of primary burner ports defined along the sidewall of the burner body and in fluid communication with the main fuel chamber;

a simmer flame port defined along the sidewall of the burner body and spaced from the plurality of primary burner ports, the simmer flame port configured to provide a reignition source for the primary burner ports; and a stability chamber located adjacent to the simmer flame port, a stability supply line for providing a gas flow to the stability chamber, the stability chamber in fluid communication with the simmer flame port and fluidly isolated from the main supply line, wherein the stability chamber and the simmer flame port are not in fluid communication with the main fuel chamber and the plurality of primary burner ports.

2. The gas burner assembly of claim 1, further comprising:

a control valve positioned along the main supply line for selectively controlling the gas flow to the main fuel chamber.

3. The gas burner assembly of claim 1, wherein the burner body comprises a stability chamber venturi defining a stability mixing throat, the stability mixing throat having an inlet and an outlet, the outlet of the stability mixing throat defining an inlet to the stability chamber.

4. The gas burner assembly of claim 3, wherein the inlet of the stability mixing throat has an inlet diameter that is greater than an outlet diameter of the outlet of the stability mixing throat.

5. The gas burner assembly of claim 3, further comprising:

a stability metering jet defining a jet orifice and positioned such that the jet orifice is in alignment and fluid communication with the inlet of the stability mixing throat, wherein one or more gaps are defined between the stability metering jet and the stability chamber venturi of the burner body to entrain air into the stability mixing throat.

6. The gas burner assembly of claim 5, wherein the gas burner assembly defines an axial direction, and wherein the burner body is mounted to a panel of the cooktop appliance, and wherein the one or more gaps defined between the stability metering jet and the stability chamber venturi are positioned above the panel along the axial direction.

7. The gas burner assembly of claim 5, wherein the jet orifice of the stability metering jet is concentrically positioned in alignment with the stability mixing throat.

8. The gas burner assembly of claim 5, wherein the burner body comprises a bottom surface, and wherein one or more ribs project from the bottom surface, wherein the one or more ribs are seated on the stability metering jet.

9. The gas burner assembly of claim 1, wherein the gas burner assembly defines an axial direction, a radial direction, and a circumferential direction extending about the axial direction, and wherein the stability chamber is defined by the cap and:

a pair of baffles extending along the radial direction and positioned in an opposing manner along the circumferential direction;

an upper surface of the burner body; and an end wall positioned inward of the simmer flame port along the radial direction and joining radially inward ends of each of the pair of baffles.

10. The gas burner assembly of claim 9, wherein the cap comprises a bottom surface and the pair of baffles each comprise a top surface, and wherein the end wall and the top surfaces of each of the pair of baffles contact the bottom surface of the cap when the cap is mounted to the burner assembly.

11. The gas burner assembly of claim 1, wherein the stability chamber is hermetically sealed from the main fuel chamber.

12. The gas burner assembly of claim 1, further comprising:

a main supply line for providing a gas flow to the main fuel chamber; and a stability supply line for providing a gas flow to the stability chamber; and a control valve configured to selectively adjust the gas flow through the main supply line.

13. The gas burner assembly of claim 12, wherein the cooktop appliance comprises a controller communicatively coupled with the control valve, the controller configured to:

control the control valve to move between an open position and a closed position to selectively adjust the gas flow through the main supply line.

14. A method for operating a gas burner assembly for a cooktop appliance in a cooking operation, the burner assembly comprising a burner body comprising a main throat defining a main mixing chamber, the burner assembly further comprising a cap mounted to the burner body, the cap and the burner body defining a main fuel chamber, the burner body defining a plurality of primary burner ports in fluid communication with the main fuel chamber and a simmer flame port spaced from the primary burner ports, the burner assembly further comprising a stability chamber located adjacent to and in fluid communication with the simmer flame port, the stability chamber and the simmer flame port are not in fluid communication with the main fuel chamber and the plurality of primary burner ports, the burner assembly further comprising a main supply line in fluid communication with the main fuel chamber, a control valve movable between an open position and a closed position and positioned along the main supply line, and a stability supply line in fluid communication with the main supply line upstream of the control valve, the stability supply line in fluid communication with the stability mixing throat, wherein the stability chamber is fluidly isolated from the main supply line, the method comprising:

closing the control valve to the closed position to shutoff a gas flow to the main fuel chamber;

determining whether a predetermined time has elapsed or whether a predetermined temperature has been met; and opening the control valve to the open position to allow the gas flow to the main fuel chamber, wherein upon opening the control valve, a simmer flame propagating through the simmer flame port ignites a plurality of flames that propagate through the plurality of primary burner ports.

15. The method of claim 14, further comprising:

commencing the cooking operation, wherein commencing the cooking operation comprises:

manipulating a control of the cooktop appliance to turn the gas burner assembly to an on position;

opening the control valve to the open position to selectively allow the gas flow to the main fuel chamber;

activating a spark igniter to ignite the gas flow in the main fuel chamber such that the plurality of flames propagate through the plurality of primary burner ports.

16. The method of claim 15, wherein upon commencing the cooking operation, one or more of the plurality of flames ignite the simmer flame in the simmer flame port.

17. The method of claim 16, further comprising:

terminating the cooking operation, wherein terminating the cooking operation comprises manipulating the control of the cooktop appliance to turn the gas burner assembly to an off position, and wherein the simmer flame is lit from a time in which the simmer flame is ignited upon commencing the cooking operation to a time that corresponds with terminating the cooking operation.

18. The method of claim 14, wherein the gas burner assembly defines an axial direction, and wherein the burner body is mounted to a top panel of the cooktop appliance, and wherein the burner assembly further comprises a stability metering jet defining a jet orifice and positioned such that the jet orifice is in alignment and fluid communication with an inlet of the stability mixing throat, wherein one or more gaps are defined between the stability metering jet and a stability chamber venturi of the burner body, the one or more gaps being defined above the top panel along the axial direction, and wherein the method further comprises:

entraining primary air located above the top panel of the cooktop appliance into the stability mixing throat through the one or more gaps between the stability metering jet and the stability chamber venturi of the burner body.

19. A cooktop appliance, comprising:

a top panel; and a gas burner assembly, comprising:

a burner body comprising a sidewall surrounding a main mixing chamber defined by a main throat having a gas inlet and a gas outlet;

a cap mounted to the burner body, the cap and the burner body defining a main fuel chamber, the main fuel chamber in fluid communication with the main mixing chamber through the gas outlet;

a plurality of primary burner ports defined along the sidewall of the burner body and in fluid communication with the main fuel chamber;

a simmer flame port defined along the sidewall of the burner body and spaced from the plurality of primary burner ports, the simmer flame port configured to provide a reignition source for the primary burner ports; and a stability chamber located adjacent to the simmer flame port, the stability chamber in fluid communication with the simmer flame port, wherein the stability chamber and the simmer flame port are fluidly isolated from the main fuel chamber; and wherein the burner body comprises a stability chamber venturi defining a stability mixing throat, the stability mixing throat having an inlet and an outlet, the outlet of the stability mixing throat defining an inlet to the stability chamber, and wherein the gas burner assembly further comprises a stability metering jet defining a jet orifice and positioned such that the jet orifice is in alignment and fluid communication with the inlet of the stability mixing throat, wherein one or more gaps are defined between the stability metering jet and the stability chamber venturi of the burner body, and wherein the burner body is mounted to the top panel of the cooktop appliance, and wherein the one or more gaps defined between the stability metering jet and the stability chamber venturi are positioned above the top panel.

* * * * *